US010403254B2

(12) United States Patent
Setoguchi

(10) Patent No.: US 10,403,254 B2
(45) Date of Patent: Sep. 3, 2019

(54) ELECTRONIC MUSICAL INSTRUMENT, AND CONTROL METHOD OF ELECTRONIC MUSICAL INSTRUMENT

(71) Applicant: CASIO COMPUTER CO., LTD., Shibuya-ku, Tokyo (JP)

(72) Inventor: Masaru Setoguchi, Kunitachi (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/130,573

(22) Filed: Sep. 13, 2018

(65) Prior Publication Data

US 2019/0096373 A1 Mar. 28, 2019

(30) Foreign Application Priority Data

Sep. 26, 2017 (JP) ..... 2017-184740

(51) Int. Cl.

| | |
|---|---|
| ***G10H 1/00*** | (2006.01) |
| ***G10H 1/06*** | (2006.01) |
| ***G10H 1/34*** | (2006.01) |
| ***G10H 7/06*** | (2006.01) |

(52) U.S. Cl.

CPC ..... *G10H 1/06* (2013.01); *G10H 1/344* (2013.01); *G10H 7/06* (2013.01)

(58) Field of Classification Search

CPC .. G10H 1/0025; G10H 2240/145; G10H 1/40; G10H 2210/066; G10H 2210/071; G10H 2210/111; G10H 2240/131; G10H 1/38; G10H 2210/091; G10H 2210/341; G10H 2240/141; G10H 3/125; G10H 1/26; G10H 2210/576; G10H 1/383; G10H 2240/135; G10H 2210/105; G10H 1/46; G10H 2240/125; G10H 1/0016; G10H 3/00; G10C 3/12; G10F 1/00

See application file for complete search history.

(56) References Cited

U.S. PATENT DOCUMENTS

| | | | | |
|---|---|---|---|---|
| 5,831,195 A * | 11/1998 | Nakata | G10H 1/36 84/609 |
| 5,841,053 A * | 11/1998 | Johnson | G10C 3/12 84/615 |
| 9,378,717 B2 * | 6/2016 | Fong | G10H 1/26 |
| 2005/0015258 A1 * | 1/2005 | Somani | G10H 1/0008 704/278 |
| 2019/0096373 A1 * | 3/2019 | Setoguchi | G10H 1/06 |

FOREIGN PATENT DOCUMENTS

| | | |
|---|---|---|
| JP | 2007286087 A | 11/2007 |
| JP | 2009193010 A | 8/2009 |
| JP | 2016164591 A | 9/2016 |

* cited by examiner

*Primary Examiner* — Marlon T Fletcher
(74) *Attorney, Agent, or Firm* — Holtz, Holtz & Volek PC

(57) ABSTRACT

According to the present invention, there is provided an electronic musical instrument, comprising: a plurality of keys; a memory that stores each pattern data showing a combination of a plurality of pitches that comprises a consonance; a speaker; and a processor that executes the following: determining processing for determining whether a combination of the operated keys matches any of the pattern data stored in the memory, first outputting processing for outputting a first sound, when the combination of the operated keys matches any of the pattern data, and second outputting processing for outputting a second sound, when the combination of the operated keys does not match any of the pattern data.

12 Claims, 7 Drawing Sheets

ELECTRONIC MUSICAL INSTRUMENT, AND CONTROL METHOD OF ELECTRONIC MUSICAL INSTRUMENT

CROSS-REFERENCE TO RELATED APPLICATIONS

This application is based upon and claims the benefit of priority from Japanese Patent Application No. 2017-184740, filed Sep. 26, 2017, the entire contents of which are incorporated herein by reference.

FIELD

The present invention relates to an electronic musical instrument, and a control method of an electronic musical instrument.

BACKGROUND

In recent years, many children in their early age are taught to learn musical instruments for better emotional development. Some electronic musical instruments have a lesson function for performance of a musical piece. However, children, whose fingers and intelligence are still at an early stage of development, often mishandle such electronic musical instruments, in such a way as banging an electronic keyboard, instead of playing the instruments properly.

On the other hand, electronic musical instruments, such as an electronic keyboard, are made for the purpose of performing music, and naturally produce a tone at a pitch corresponding to each key.

PATENT LITERATURE 1: Jpn. Pat. Appln. KOKAI Publication No. 2007-286087

Accordingly, a conventional keyboard produces pitches corresponding to a plurality of pressed keys, even when such keys are hit randomly. Even when a chord is intended to be played, no musically correct chord is produced since keys are hit randomly, and a random dissonance is produced.

How to play instruments properly and correct chords can be learned with an instructor. However, without an instructor, there has been a problem that children gradually become bored with a musical instrument without knowing how to perform properly, and lose interest in a musical instrument itself.

SUMMARY

The present invention is made in view of the above circumstances, and an advantage of the present invention is to provide an electronic musical instrument and a control method of an electronic musical instrument with which children become familiar, irrespective of how children operate the electronic musical instrument.

According to a first aspect of the invention, there is provided an electronic musical instrument, comprising: plurality of keys that specify different pitches respectively when operated; a memory that stores each pattern data showing a combination of a plurality of pitches that comprises a consonance; a speaker; and a processor that executes the following: determining processing for determining, in response to an operation of the plurality of keys, whether a combination of the operated keys matches any of the pattern data stored in the memory, first outputting processing for outputting a first sound from the speaker, when the combination of the operated keys matches any of the pattern data, wherein the first sound is generated based on both the pitches specified by the operated keys and sound volume information obtained by the operation, and second outputting processing for outputting a second sound different from the first sound from the speaker, when the combination of the operated keys does not match any of the pattern data, wherein the second sound is generated not based on at least one of the pitches specified by the operated keys and the sound volume information obtained by the operation.

BRIEF DESCRIPTION OF THE DRAWINGS

The present invention will be more understood with reference to the following detailed descriptions with the accompanying drawings.

DETAILED DESCRIPTION

Hereinafter, description will be made on an electronic musical instrument according to an embodiment of the present invention with reference to the accompanying drawings.

The electronic musical instrument of the embodiment is an electronic keyboard having a light key, and performs special sound producing processing (processing performed when a second condition is satisfied), which is different from normal sound producing processing (processing performed when a first condition is satisfied) where sound producing processing is performed based on a pitch corresponding to a pressed key, even when a child, whose fingers and intelligence are still at an early stage of development, presses keys of a keyboard randomly or bangs a keyboard roughly. In this manner, a child feels joy and becomes familiar with the electronic keyboard.

1. Regarding Electronic Keyboard 100

Hereinafter, description will be made on an electronic musical instrument according to the embodiment with reference to FIGS. 1 and 2. An electronic keyboard 100 shown in FIGS. 1 and 2 is used in operation of the electronic keyboard 100 in first to third embodiments described later.

Figure 1:
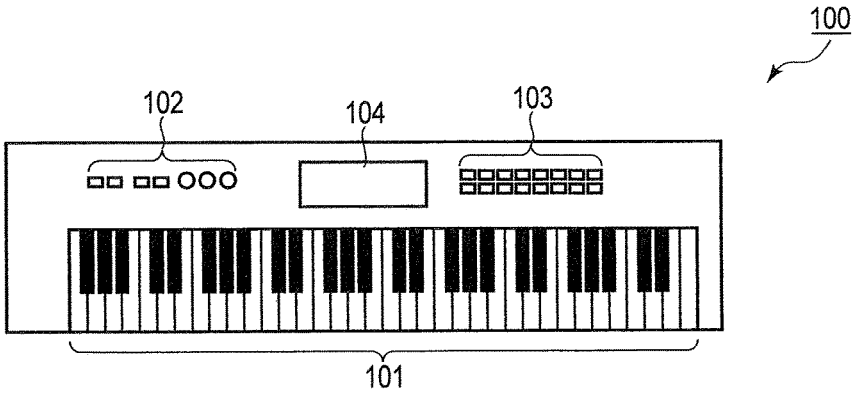
FIG. 1 is a diagram showing an appearance of an electronic keyboard 100 according to an embodiment.

FIG. 1 is a diagram showing an appearance of the electronic keyboard 100 according to the embodiment.

As shown in FIG. 1, the electronic keyboard 100 includes a keyboard 101 having a plurality of keys as playing operation elements that designate pitches and each of the keys has a light-up function, a first switch panel 102 that designates a sound volume, sets a tempo of automatic playing, and instructs a variety of settings for start of automatic playing and the like, a second switch panel 103 for selecting the special sound producing processing according to the present embodiment, selecting a piece for automatic playing, selecting a tone color, and the like, and a liquid crystal display (LCD) 104 that displays lyrics at the time of automatic playing and a variety of types of setting information. Although not specifically illustrated, the electronic keyboard 100 includes a speaker that emits a sound of music generated by playing the keyboard on a bottom surface section, a side surface section, a back surface section, or the like.

Figure 2:
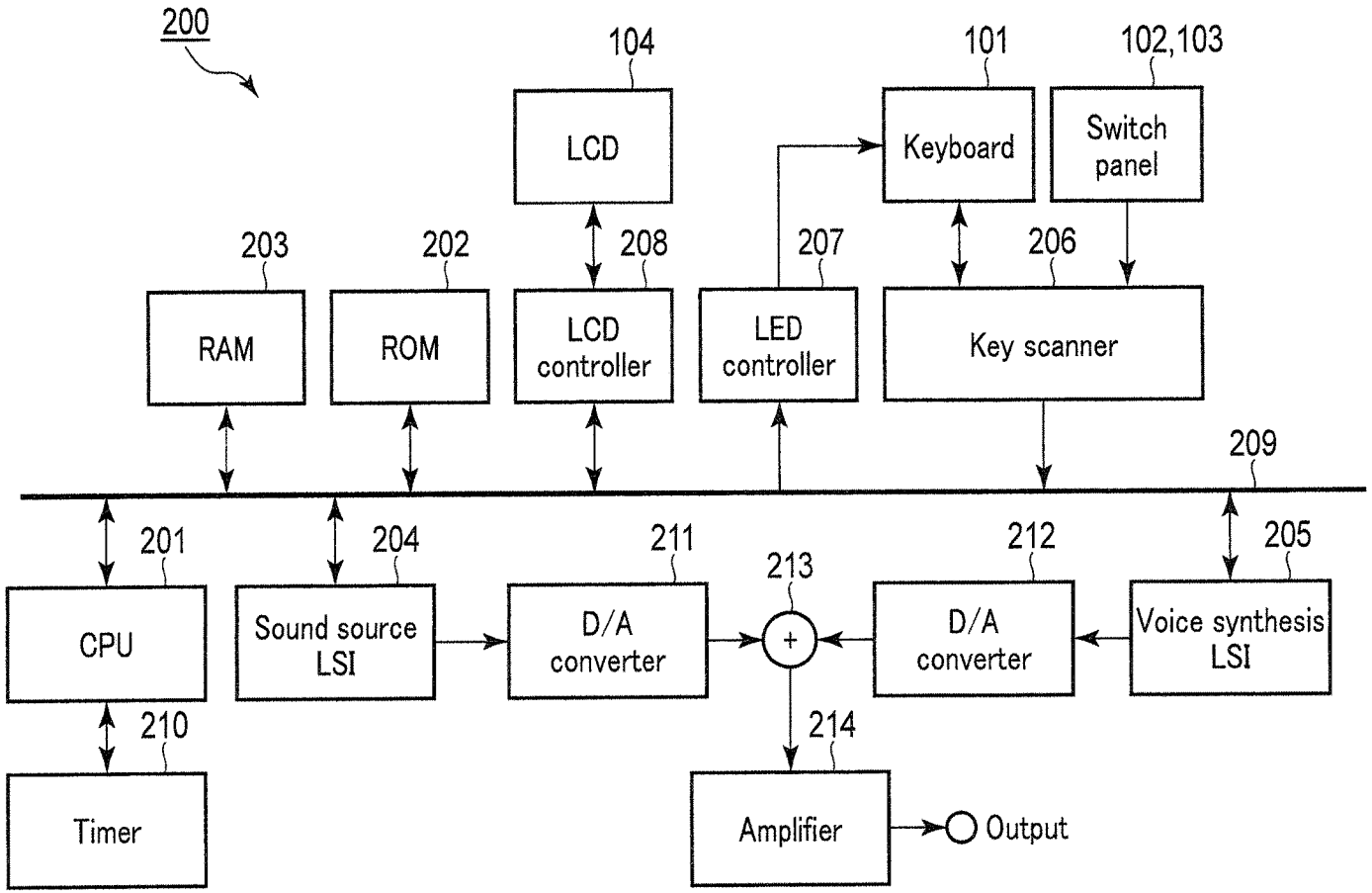
FIG. 2 is a diagram showing hardware of a control system 200 of the electronic keyboard 100 according to an embodiment.

FIG. 2 is a diagram showing hardware of a control system 200 of the electronic keyboard 100 according to the embodiment. In FIG. 2, the control system 200 includes a CPU 201, a ROM 202, a RAM 203, a sound source LSI 204, a voice synthesis LSI 205, a key scanner 206 to which the keyboard 101, the first switch panel 102, and the second switch panel 103 of FIG. 1 are connected, an LED controller 207 that controls light emission of each light emitting diode (LED) for lighting up each key of the keyboard 101 of FIG. 1, an LCD controller 208 to which the LCD 104 of FIG. 1 is connected, and a system bus 209. The CPU 201, the ROM 202, the RAM 203, the sound source LSI 204, the voice synthesis LSI 205, the key scanner 206, the LED controller 207, and the LCD controller 208 are connected to the system bus 209.

The CPU 201 executes control operation of the first to third embodiments described later of the electronic keyboard 100 by executing a control program stored in the ROM 202 by using the RAM 203 as a work memory. The CPU 201 provides an instruction to the sound source LSI 204 and the voice synthesis LSI 205 included in a source section in accordance with a control program. In this manner, the sound source LSI 204 and the voice synthesis LSI 205 generate and output digital music sound waveform data and digital singing voice data.

Digital music sound waveform data and digital singing voice data output from the sound source LSI 204 and the voice synthesis LSI 205 are converted to an analog music sound waveform signal and an analog singing voice signal by D/A converters 211 and 212. The analog music sound waveform signal and the analog singing voice signal are mixed by a mixer 213, and the mixed signal is amplified by an amplifier 214 and output from a speaker or an output terminal (not specifically shown).

The CPU 201 stores velocity information included in information showing a state of a key of the keyboard 101 notified from the key scanner 206 in the RAM 203 in a manner that the velocity information is associated with a key number. The "velocity" shows "loudness of a sound" of a pressed key. The loudness of a sound is obtained by detecting a speed of pressing of a key of a keyboard in a musical instrument digital interface (MIDI), and expressed as a numerical value from 1 to 127.

A timer 210 used for controlling a sequence of automatic playing is connected to the CPU 201.

The ROM 202 stores a control program that performs processing relating to the embodiment, a variety of types of fixed data, and automatic playing piece data. The automatic playing piece data includes melody data played by a performer, and accompaniment music data corresponding to the melody data. The melody data includes pitch information of each sound, sound producing timing information of each of the sound. The accompaniment piece data is not limited to accompaniment music corresponding to melody data, and may be data of a singing voice, a voice of a person, and the like.

A sound producing timing of each sound may be an interval time period between each produced sounds, or may be an elapsed time period from start of an automatic playing piece. A unit of time is based on a tempo called "tick" used in a general sequencer. For example, when a resolution of a sequencer is 480, 1/480 of a time period of a quarter note is 1 tick. A storage location of the automatic playing piece data is not limited to the ROM 202, and may be an information storage device and an information storage medium (not shown).

A format of automatic playing piece data may conform to an MIDI file format.

The ROM 202 stores a control program for performing processing relating to the embodiment as described above, as well as data used in the processing relating to the embodiment. For example, the ROM 202 stores pattern data which is a combination of pitches of a chord used in the third embodiment described later.

While chords include a triad, a tetrad, and a pentad, data of a combination of pitches relating to a triad is stored in the embodiment. Types of chords in a triad include a major triad, a minor triad, a diminished triad, and an augmented triad. The ROM 202 stores data of a combination of pitches of a major triad, a minor triad, a diminished triad, and an augmented triad as pattern data.

The sound source LSI 204 reads out music sound waveform data from a waveform ROM (not shown), and outputs the data to the D/A converter 211. The sound source LSI 204 has the ability of simultaneously oscillating 256 voices at a maximum.

When given text data, a pitch, and a length of lyrics from the CPU 201, the voice synthesis LSI 205 synthesizes voice data of a singing voice corresponding to the given text data, pitch, and length, and outputs the synthesized voice data to the D/A converter 212.

The key scanner 206 constantly operates a key pressed or unpressed state of the keyboard 101 of FIG. 1, and a switch operation state of the first switch panel 102 and the second switch panel 103, and interrupts the CPU 201 to notify a state change.

The LED controller 207 is an integrated circuit (IC) that navigates playing of a performer by lighting up a key of the keyboard 101 based on an instruction from the CPU 201.

The LCD controller 208 is an IC that controls a display state of the LCD 104.

Next, description will be made on a control method of the electronic keyboard 100 according to the embodiment of the present invention. The control method of the electronic keyboard 100 according to the first to third embodiments described below is implemented in the electronic keyboard 100 shown in FIGS. 1 and 2.

Figure 3:
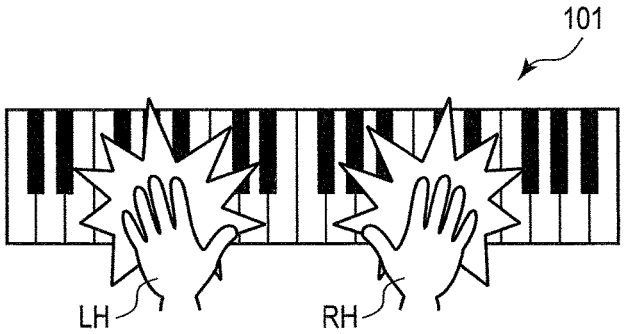
FIG. 3 is a diagram for explaining a case where a child bangs randomly a keyboard 101 with both hands (a left hand LH and a right hand RH).

Next, description will be made on control operation of the electronic keyboard 100 according to the first embodiment of the present invention. As shown in FIG. 3, the embodiment assumes a case where a child bangs randomly the keyboard 101 with both hands (a left hand LH and a right hand RH).

Figure 4:
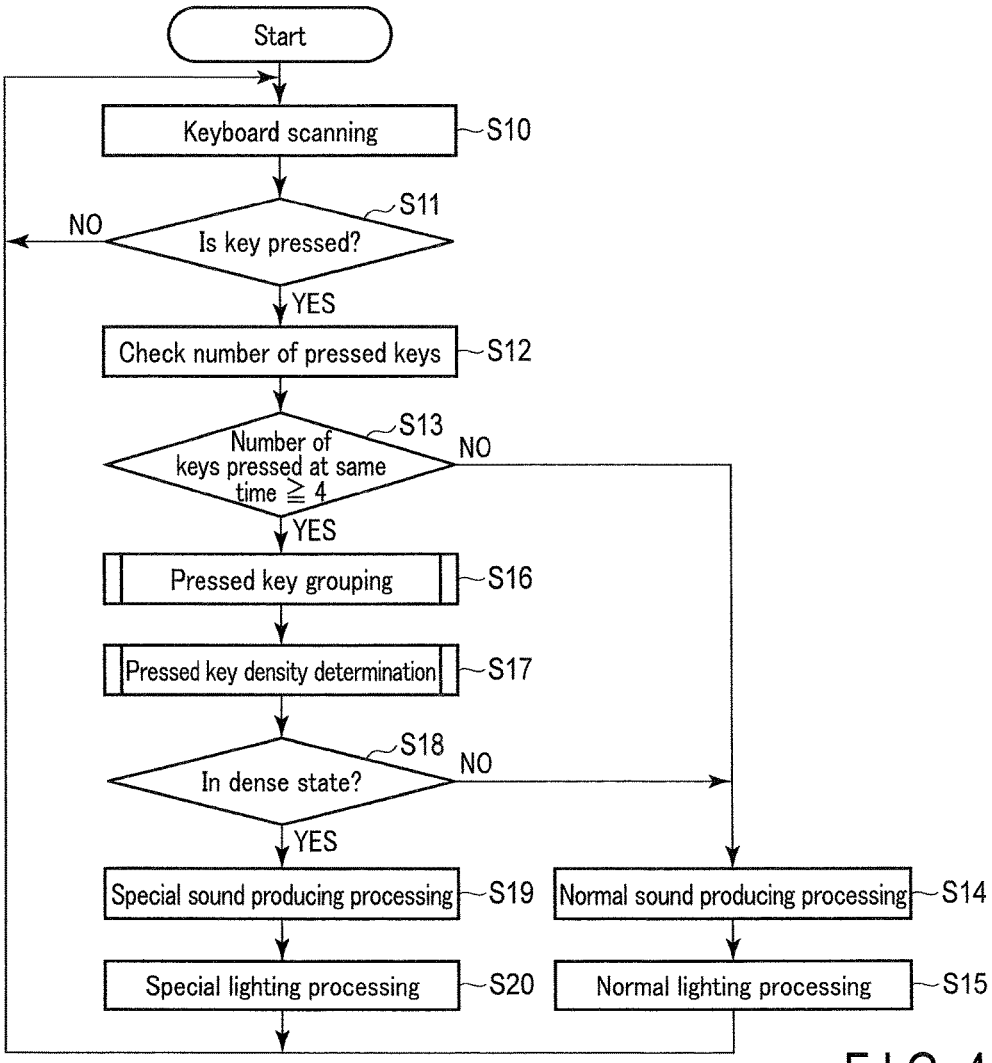
FIG. 4 is a flowchart for explaining operation of the electronic keyboard 100 according to a first embodiment of the present invention.

2. First Embodiment 2-1. Operation of the Electronic Keyboard 100 According to the First Embodiment FIG. 4 is a flowchart for explaining operation of the electronic keyboard 100 according to the first embodiment of the present invention.

When operation of the electronic keyboard 100 of the present embodiment is started, the key scanner 206 first performs keyboard scanning of the keyboard 101 (S10). The operation may be started when a switch (not shown) of the special sound producing processing according to the embodiment in the second switch panel 103 is selected, or may be automatically executed by a control program stored in the ROM 202 after the electronic keyboard 100 is turned on.

As a result of the keyboard scanning in S10, whether a key of the keyboard 101 is pressed is determined (S11). When determined that no key is pressed in S11, the operation returns to the processing of S10.

On the other hand, when determined that a key is pressed, the number of keys pressed at the same time is acquired from the result of the keyboard scanning (S12). Whether or not the number of keys pressed at the same time acquired in S12 is four or more is determined (S13). The number of keys pressed at the same time is, for example, the number of pressed keys acquired in the keyboard scanning performed in S10. Alternatively, the number of keys pressed at the same time may be the number of keys pressed within a predetermined period of time. The number of keys pressed at the same time to be determined is set to four. This is because, when the number of keys pressed at the same time is four or larger, there is possibility that a child bangs the keyboard 101 instead of performing playing operation by designating a key included in the keyboard 101.

When the number of keys pressed at the same time is determined to be smaller than four (the first condition is satisfied) in S13, the normal sound producing processing is performed (S14). The normal sound producing processing in S14 produces a normal sound of a musical instrument that produces a sound at a pitch corresponding to a pressed key.

Specifically, when an instruction for producing a sound at a pitch according to a pressed key is given from the CPU 201 to the sound source LSI 204 included in the sound source section, the sound source LSI 204 reads out waveform data at a corresponding pitch from a waveform ROM (not shown), and outputs waveform data (first waveform data) at the readout pitch to the D/A converter 211. Normal lighting processing (S15) is performed subsequent to the normal sound producing processing, and the operation returns to the processing of S10. The normal lighting processing causes a pressed key to emit light.

On the other hand, when the number of keys pressed at the same time is determined to be four or larger in S13, the operation proceeds to pressed key grouping processing (S16).

The pressed key grouping processing of S16 classifies keys into a first group including keys hit by a left hand and a second group including keys hit by a right hand when the keyboard 101 is hit by the left hand and the right hand. The pressed key grouping processing of S16 will be described later in description of FIG. 5.

After the pressed key grouping processing is performed in S16, pressed key density determination is performed (S17). The pressed key density determination processing determines whether a state of pressed keys in the first group and the second group is a dense state or a dispersed state. The pressed key density determination processing will be described later in description of FIG. 6.

Whether a pressed key state is a dense state or a dispersed state is determined in S17. When the pressed key state is determined as a dense state, random playing is determined to be performed (when the second condition is satisfied), the operation moves to the special sound producing processing of S19 (YES in S18). On the other hand, when the pressed key state is determined to be a dispersed state in S17, the operation moves to the normal sound producing processing of S14 (NO in S18). In the special sound producing processing of S19, voice data of phrases, such as "Please don't do that!" and "I'm going to be broken!", is read out from the ROM 202 and a sound of the voice data is produced, instead of the normal sound producing processing of S14 that produces a sound at a pitch corresponding to a pressed key.

That is, in output processing, a sound of voice corresponding to a piece of phrase data among a plurality of phrase data stored in a memory is emitted from a speaker without being based on a plurality of pitch information associated with operation elements operated by a performer.

Alternatively, an instruction for producing a sound of a corresponding phrase may be provided from the CPU 201 to the voice synthesis LSI 205 included in the sound source section together with text data, a pitch, and a length of the phrase, so that the voice synthesis LSI 205 synthesizes corresponding voice data and outputs a waveform (second waveform data) of the synthesized voice data to the D/A converter 212.

After the special sound producing processing in S19, special lighting processing is performed (S20). Unlike the normal lighting processing of S15, the special lighting processing does not perform light emission of a key corresponding to a pressed key.

Instead, the special lighting processing of S20 performs a light emission pattern different from that of the normal lighting processing of S15, such as light emission in which light spreads from a pressed key to keys on the left and right to make an explosion-like movement. For the special lighting processing of S20, a variety of light emission patterns different from that in the normal lighting processing can be considered. As a specific method of performing the special lighting processing, for example, the LED controller 207 has several light emission patterns, and the CPU 201 instructs the LED controller 207 of a number assigned to a pressed key and a light emission pattern, so that the special lighting processing is performed.

For example, in the processing of performing light emission of an explosion-like movement described above, the CPU 201 instructs the LED controller 207 of a number assigned to a pressed key and a light emission pattern of the explosion-like movement. In this manner, the LED controller 207 sequentially turns on and off the light of keys on the left and right of a pressed key, keys on the left and right of the pressed key with one key interposed between the keys and the pressed key, keys on the left and right of the pressed key with two keys interposed between the keys and the pressed key, keys on the left and right of the pressed key with three keys interposed between the keys and the pressed key, and so on, with the pressed key in the middle between the keys on the left and right. By this operation, the light emission processing of an explosion-like movement, in which light spreads to keys on the left and right, is performed.

A key number of an LED to be lit up by the special lighting processing may be directly notified from the CPU 201 to the LED controller 207. After the special lighting processing in S20, the operation returns to the processing of S10.

Figure 5:
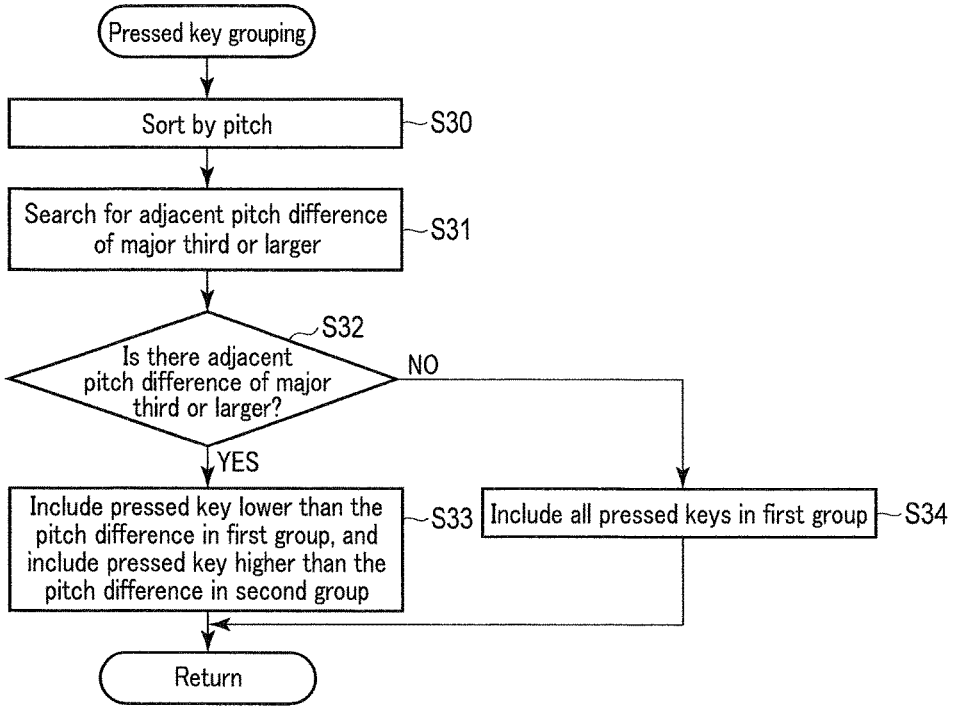
FIG. 5 is a flowchart for explaining pressed key grouping processing of S16 of FIG. 4.

Next, description will be made on the pressed key grouping processing of S16 with reference to a flowchart of FIG. 5.

As shown in FIG. 3, the pressed key grouping processing is preprocessing for grouping pressed keys into a first group including a key hit by a left hand (LH) and a second group including a key hit by a right hand (RH) so as to determine whether the keys are really pressed randomly in each of the groups when the keyboard 101 is hit by the left hand (LH) and the right hand (RH).

First, pressed keys are sorted by pitch (S30). In sorting by pitch, for example, pitch information corresponding to pressed keys are sorted in order from a lowest pitch to a highest pitch. By this processing, a pitch difference between adjacent pitches described later can be easily determined.

After the above, a pitch difference between pitches sorted in S30 that is larger than or equal to a major third is searched for (S31). When there is a pitch difference of a major third or larger, this means that there is a gap of at least one white key. In the first embodiment, this gap is determined as a boundary between the left hand and the right hand.

When a pitch difference of a major third or larger is found in S31 (YES in S32), a pressed key lower than a gap having the pitch difference is included in the first group, and a pressed key higher than the gap is included in the second group (S33). When no pitch difference of a major third or larger is found (NO in S32), all pressed keys are included in the first group (S34).

When a plurality of pitch differences of a major third or larger are found, a gap having a largest pitch difference may be determined as a boundary between the left hand and the right hand.

Figure 6:
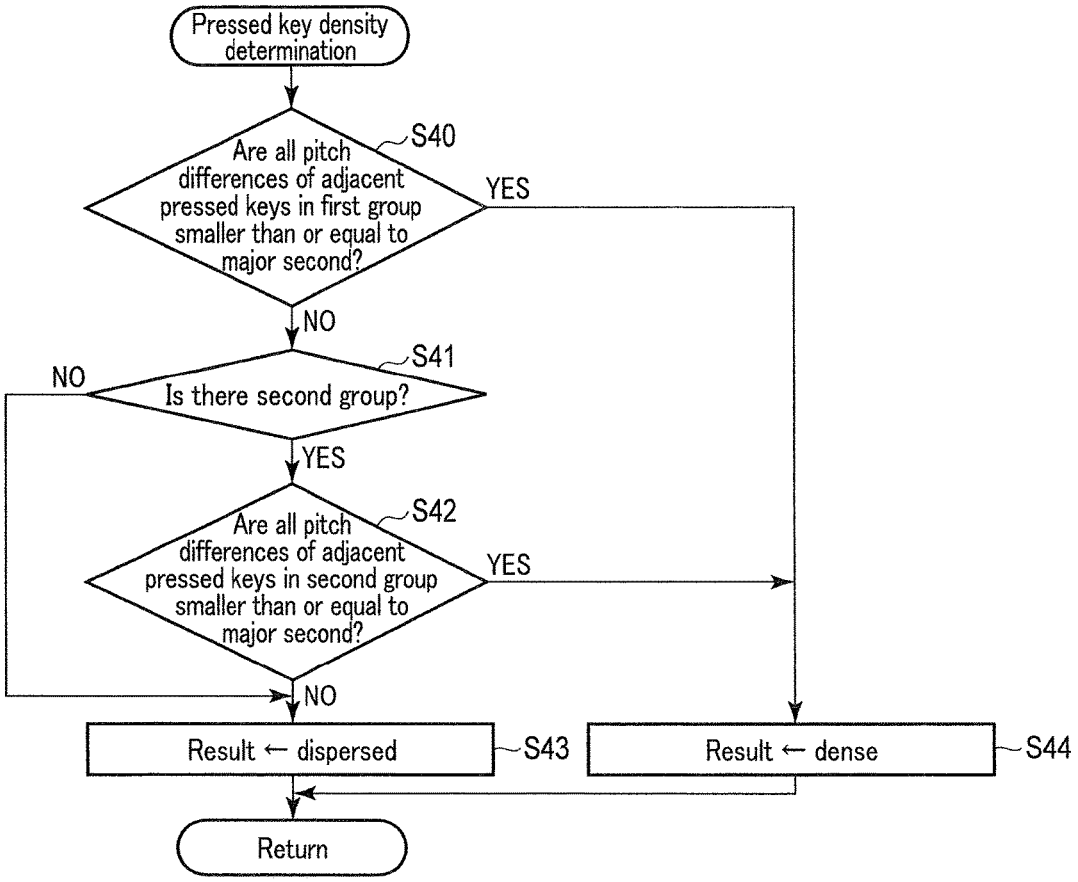
FIG. 6 is a flowchart for explaining pressed key density determination processing of S17 of FIG. 4.

After pressed keys are grouped, density determination of a pressed key state is performed for each group. FIG. 6 is a flowchart for explaining the pressed key density determination processing of S17.

First, a determination is made as to whether all pitch differences between all pressed keys adjacent to each other in the first group are a major second or smaller (S40). When a pitch difference is a major second or smaller, white keys or black keys adjacent to each other are pressed without a gap between them. Accordingly, random playing is determined to be performed in the first embodiment.

When all pitch differences between pressed keys adjacent to each other are determined to be a major second or smaller in S40, a result of the pressed key density determination shows a dense state (S44). On the other hand, when not all pitch differences between adjacent pressed keys are determined to be a major second or smaller, a determination is made as to whether or not there is the second group (S41).

When determined that there is the second group in S41, a determination is made as to whether all pitch differences between adjacent pitches are a major second or smaller for all pitches in the second group, like the processing performed for the first group in S40 (S42). On the other hand, when determined that there is no second group in S41, a result of the pressed key density determination shows a dispersed state (S43).

When all pitch differences between adjacent pitches are determined to be a major second or smaller in S42, a result of the pressed key density determination shows a dense state (S44). On the other hand, when not all pitch differences between pressed keys adjacent to each other are determined to be a major second or smaller, a result of the pressed key density determination shows a dispersed state (S43).

2-2. Variation of the First Embodiment 2-2-1. First Variation of the Special Sound Producing Processing (S19)

In the first embodiment described above, description has been made on the case where a sound of phrases, such as "Please don't do that!" and "I'm going to be broken!", is produced in the special sound producing processing of S19. However, sounds produced in the special sound producing processing are not limited to the above.

For example, the special sound producing processing of S19 may instruct a method of pressing a correct key by voice, produce an explosion sound, and produce a sound obviously different from a normal sound of a musical instrument.

In a case where random playing can be determined to be continuing, processing of gradually changing a sound to be produced to liven up the playing may be performed in special sound production. The case where random playing can be determined to be continuing is a case where, for example, the number of times that the CPU 201 determines a result of the pressed key density determination processing of S17 as a dense state is larger than or equal to a predetermined number of times within a predetermined period of time.

Further, a sound having a sound volume different from that of a sound produced in the normal sound producing processing (S14) may also be produced. For example, a sound produced in the special sound producing processing (S19) may be lower than a sound produced in the normal sound producing processing (S14).

More specifically, a sound volume of waveform data (second waveform data) output from the sound source section in the special sound producing processing (S19) is made smaller than a sound volume of waveform data (first waveform data) output from the sound source section in the normal sound producing processing (S14).

2-2-2. Second Variation of the Special Sound Producing Processing (S19)

In the first embodiment, description has been made on the case where the normal sound producing processing (S14) or the special sound producing processing (S19) is performed in accordance with the number of keys pressed at the same time (the first condition) and a dense state of pressed keys (the second condition). However, the present invention is not limited to this configuration. For example, even when the special sound producing processing (S19) is performed since the number of keys pressed at the same time is larger than or equal to a predetermined number, the normal sound producing processing may also be performed in addition to the special sound producing processing (S19). That is, the sound source section may output the second waveform data in addition to the first waveform data.

2-2-3. Third Variation of the Special Sound Producing Processing (S19)

In the first embodiment, description has been made on the case where pressed keys are determined to be in a dense state and the special sound producing processing (S19) is performed when a pitch difference between adjacent pressed keys is a major second or smaller in either one of the first group (left hand) and the second group (right hand).

However, the configuration may be such that the special sound producing processing (S19) is performed for the first group (left hand) or the second group (right hand) determined to be in a dense state, and the normal sound producing processing (S14) for producing a sound of a pitch corresponding to a pressed key is performed together with the special sound producing processing for the first group (left hand) or the second group (right hand) that is determined to be in a dispersed state.

2-2-4. Conditions of the Special Sound Producing Processing

In the first embodiment, description has been made on the case where the normal sound producing processing (S14) or the special sound producing processing (S19) is performed in accordance with the number of keys pressed at the same time (the first condition) and a dense state of pressed keys (the second condition). However, another condition (third condition) may also be added. As the third condition, for example, velocity information of a pressed key that will be described later in the second embodiment may be added.

2-2-5. The Number of Keys Pressed at the Same Time

In the first embodiment, description has been made on the determination as to whether the number of keys pressed at the same time in S12 is four or larger. However, the number of keys pressed at the same time to be determined may be three or larger.

2-3. Advantages of the First Embodiment

According to the electronic keyboard 100 of the first embodiment of the present invention, when a predetermined or larger number of keys are pressed and a density determination of a pressed key state is performed, special sound production different from normal sound production is performed. Accordingly, a child can enjoy playing the electronic keyboard 100 of the embodiment without feeling bored. That is, the electronic keyboard 100 with which the user, such as a child, can become familiar can be provided.

A sound volume of the special sound production can be made lower than a sound volume of the normal sound production. This configuration can prevent causing trouble to people around, even when a child randomly presses keys of the keyboard 101.

Further, by performing special lighting processing in addition to the special sound production, the electronic keyboard 100 that children are more attracted to and familiar with can be provided.

3. Second Embodiment 3-1. Operation of the Electronic Keyboard 100 According to the Second Embodiment Next, description will be made on operation of the electronic keyboard 100 according to the second embodiment of the present invention.

In the second embodiment, the special sound producing processing is performed based on velocity information of a pressed key.

Figure 7:
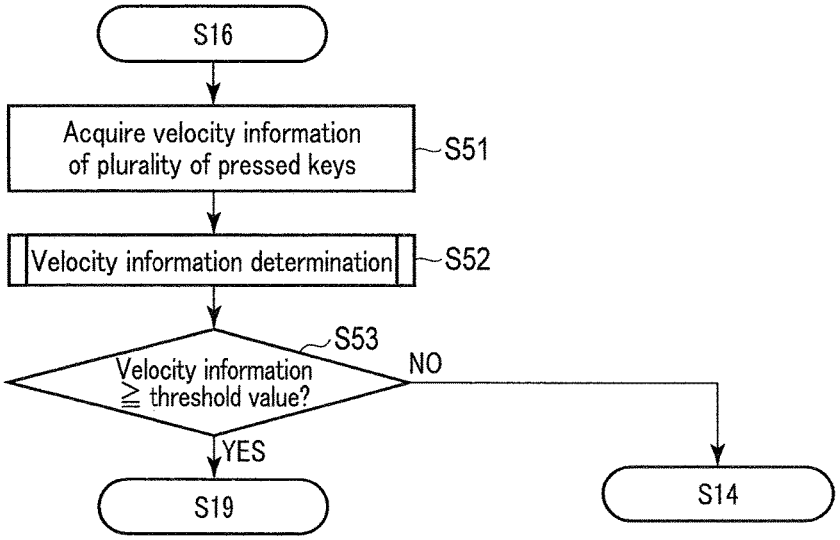
FIG. 7 is a flowchart for explaining operation of the electronic keyboard 100 according to a second embodiment of the present invention.

FIG. 7 is a flowchart for explaining operation of the electronic keyboard 100 according to the second embodiment of the present invention.

Processing of S10 to S16, S19, and S20 in a flowchart of the first embodiment shown in FIG. 4 is the same as that in the operation described in the first embodiment, and will be omitted from description below.

As shown in FIG. 7, when the pressed key grouping processing is performed in S16, the CPU 201 acquires velocity information of each of a plurality of pressed keys stored in the RAM 203 (S51).

Next, velocity information determination processing is performed for each of a plurality of pressed keys acquired in S51 (S52). The velocity information determination processing is performed for a pressed key group obtained by the grouping in S16 of FIG. 4. The velocity information determination processing of S52 will be described later.

Next, all values of the velocity information of a plurality of pressed keys are determined to reach a threshold value as a result of the velocity information determination processing of S52 (YES in S53), the operation moves to the special sound producing processing of S19 of FIG. 4. On the other hand, not all values of the velocity information of a plurality of pressed keys are determined to reach the threshold value (NO in S53), the operation moves to the normal sound producing processing of S14.

Figure 8:
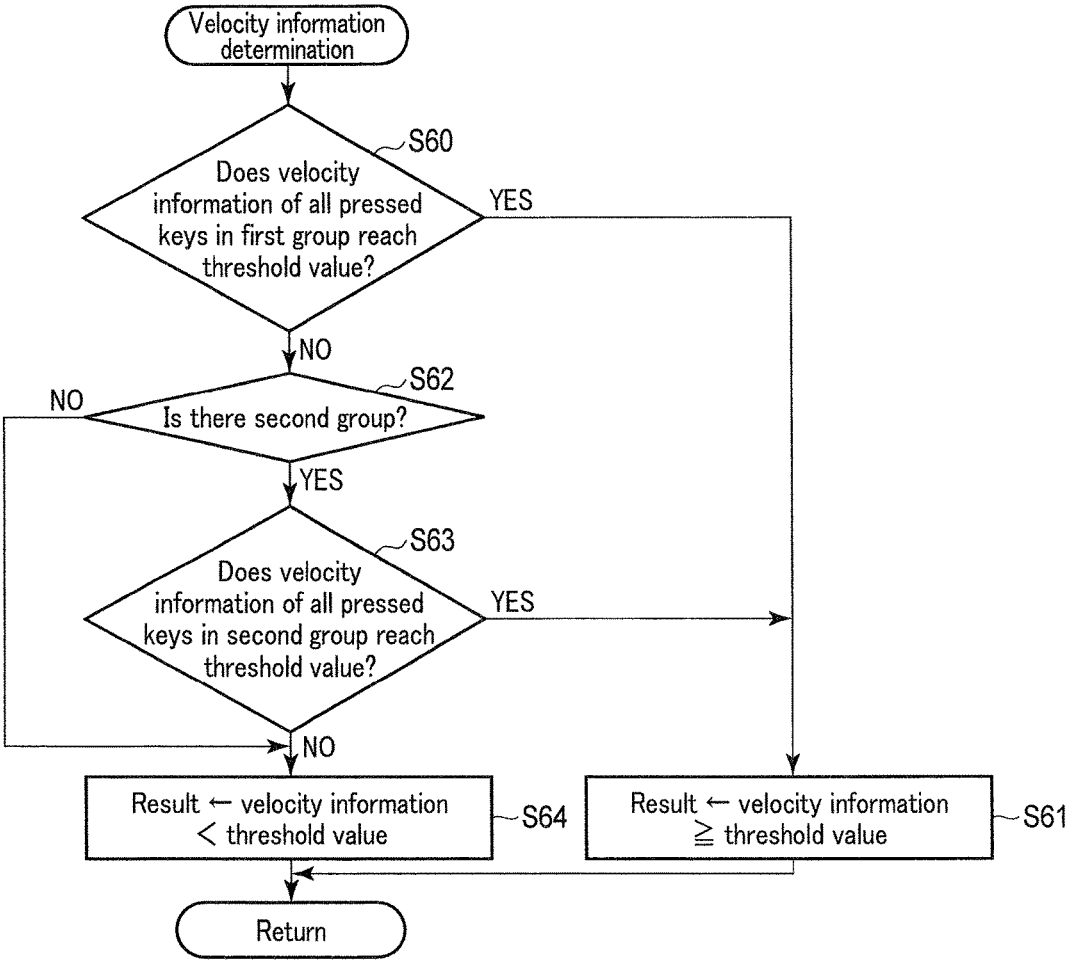
FIG. 8 is a flowchart for explaining velocity information determination of S52 of FIG. 7.

FIG. 8 is a flowchart for explaining the velocity information determination of S52.

As shown in FIG. 8, a determination is made as to whether all values of velocity information of all pressed keys in the first group reach a threshold value (S60). In the second embodiment, when all values of velocity information of all pressed keys reach the threshold value (YES in S60), random playing is determined to be performed.

When values of velocity information of all pressed keys in the first group are determined to reach the threshold value in S60, a result of the velocity information determination shows velocity information≥threshold value (S61). On the other hand, when values of velocity information of not all pressed keys in the first group are determined to reach the threshold value (NO in S60), a determination is made as to whether or not there is the second group (S62).

When determined that there is the second group in S62, a determination is made as to whether values of velocity information of all pressed keys in the second group reach the threshold value, like the processing performed for the first group in S60 (S63). On the other hand, when determined that there is no second group in S62, a result of the velocity information determination shows velocity information<threshold value (S64).

When values of velocity information of all pressed keys in the second group are determined to reach the threshold value in S63, a result of the velocity information determination shows velocity information≥threshold value (S61). On the other hand, when values of velocity information of not all pressed keys in the second group are determined to reach the threshold value, a result of the velocity information determination shows velocity information<threshold value (S64).

3-2. Variation of the Second Embodiment 3-2-1. Determination of Velocity Information In the second embodiment, description has been made on the case where a determination is made based on whether or not values of velocity information of all pressed keys of the first group and the second group reach a threshold value. However, the present invention is not limited to this configuration. The configuration may be such that, for example, when values of velocity information of a predetermined or larger number of pressed keys exceed the threshold value, a result of the velocity determination shows velocity information≥threshold value and the special sound producing processing is performed. For example, when the number of pressed keys is seven and values of velocity information of three or more pressed keys exceed the threshold value, the special sound producing processing may be performed.

3-3. Advantages of the Second Embodiment

According to the electronic keyboard 100 of the second embodiment of the present invention, velocity information of a pressed key is used as the basis. Accordingly, the special sound producing processing can be performed more in consideration of an emotion of a child, and a child can enjoy playing the electronic keyboard 100 of the embodiment without feeling bored.

4. The Third Embodiment

In the third embodiment, a child is not considered to intentionally play a tension chord including a dissonance. Accordingly, when a dissonance is included in a combination of pressed keys, random playing is considered to be performed.

4-1. Operation of the Electronic Keyboard 100 According to the Third Embodiment Description will be made on operation of the electronic keyboard 100 according to the third embodiment of the present invention.

Figure 9:
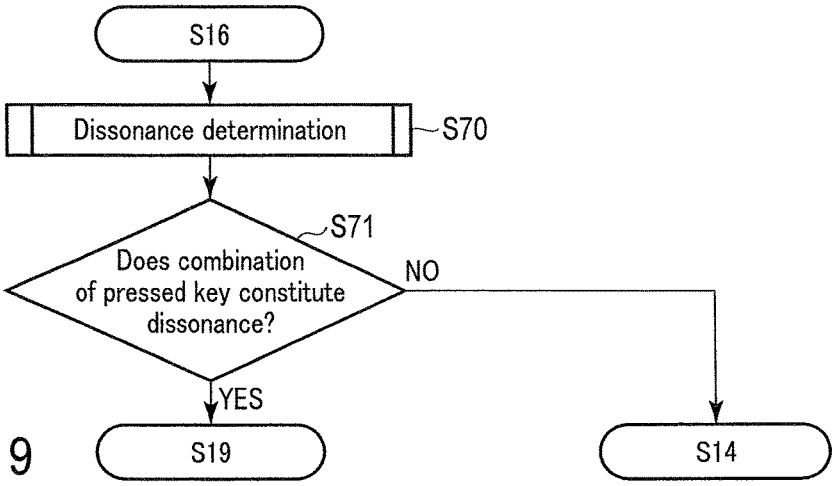
FIG. 9 is a flowchart for explaining operation of the electronic keyboard 100 according to a third embodiment of the present invention.

FIG. 9 is a flowchart for explaining operation of the electronic keyboard 100 according to the third embodiment of the present invention.

Processing of S10 to S16, S19, and S20 in a flowchart of the first embodiment shown in FIG. 4 is the same as that in the operation described in the first embodiment, and will be omitted from description below.

As shown in FIG. 9, when the pressed key grouping processing is performed in S16, a determination is made as to whether a combination of pressed keys constitutes a dissonance (S70). The dissonance determination processing in S70 is performed for a pressed key group obtained by the grouping in S16 of FIG. 4. The dissonance processing of S70 will be described later.

Next, when a combination of pressed keys is determined to constitute a dissonance as a result of the dissonance determination processing of S70 (YES in S71), the operation moves to the special sound producing processing of S19 of FIG. 4. On the other hand, when a combination of pressed keys is not determined to constitute a dissonance, the operation moves to the normal sound producing processing of S14.

In the normal sound producing processing of S14, first sound may be output from the speaker. The first sound is generated based on both the pitches specified by the operated keys and sound volume information obtained by the operation.

Figure 10:
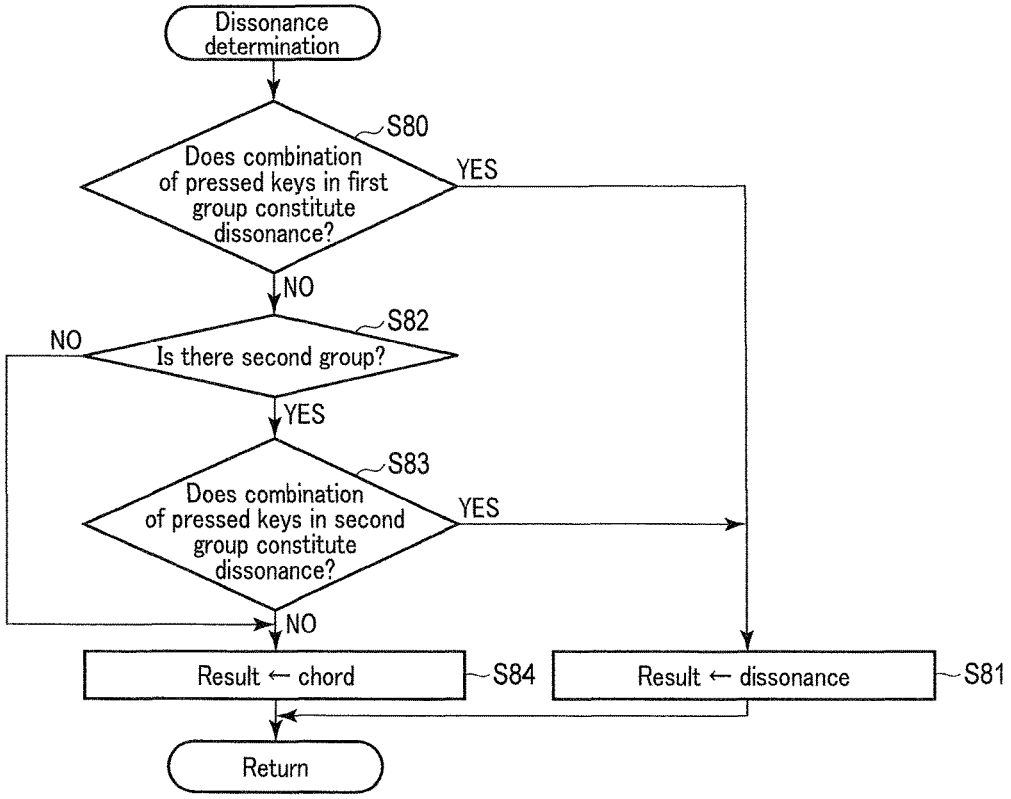
FIG. 10 is a flowchart for explaining dissonance determination processing of S70.

FIG. 10 is a flowchart for explaining the dissonance determination processing of S70.

As shown in FIG. 10, a determination is made as to whether a combination of pressed keys in the first group constitutes a dissonance (S80).

Specifically, as to whether or not a combination of pressed keys constitutes a dissonance, a determination is made as to whether a combination of pitches of pressed keys in the first group matches with pattern data showing a combination of pitch data of a chord stored in the ROM 202. When matching with the pattern data, the combination does not constitute a dissonance. When not matching with the pattern data, the combination constitutes a dissonance.

When a combination of pressed keys is determined to constitute a dissonance in S80 (YES in S80), a result of the dissonance determination shows a dissonance (S81). On the other hand, when a combination of pressed keys in the first group is determined not as a dissonance (NO in S80), a determination is made as to whether or not there is the second group (S82).

When determined that there is the second group in S82 (YES in S82), a determination is made as to whether a combination of pressed keys in the second group constitutes a dissonance, like the processing performed for the first group in S80 (S83). On the other hand, when determined that there is no second group (NO in S82), a result of the dissonance determination shows a chord (S84).

When a combination of pressed keys in the second group is determined to constitute a dissonance in S83 (YES in S83), a result of the dissonance determination shows a dissonance (S81). On the other hand, when a combination of pressed keys in the second group is determined not to constitute a dissonance (NO in S83), a result of the dissonance determination shows a chord (S84).

4-2. Variation of the Third Embodiment 4-2-1. First Variation of the Special Sound Producing Processing (S19)

In the first embodiment described above, description has been made on the case where a sound of phrases, such as "Please don't do that!" and "I'm going to be broken!", is produced in the special sound producing processing of S19. However, in the third embodiment, a consonance may be produced regardless of a pitch of a pressed key.

A consonance having a root at a lowest pitch of a combination of pressed keys that constitute a dissonance may also be produced.

4-2-2. Second Variation of the Special Sound Producing Processing (S19)

In the third embodiment, description has been made on the case where the special sound producing processing (S19) is performed when a combination of pressed keys in the first group or the second group constitutes a dissonance. However, the present invention is not limited to this configuration.

The configuration may be such that, for example, when there is a dissonance in the first group (left hand) and the second group (right hand), a consonance having a root at a lowest pitch of a combination of pressed keys that constitute a dissonance in the first group is produced, and, for the second group, a consonance that is an octave higher than the consonance of the first group is produced.

The configuration may also be such that, when there is a dissonance in the first group (left hand) and the second group (right hand), a consonance having a root at a lowest pitch of a combination of pressed keys that constitute a dissonance in the second group is produced, and, for the first group, a consonance that is an octave lower than the consonance of the second group is produced.

4-2-3. Patten Data of a Chord

In the third embodiment, description has been made on the case where pattern data of a chord stored in the ROM 202 is pattern data of a triadic. However, pattern data of a tetrad and a pentad may also be stored.

4-3. Advantages of the Third Embodiment

According to the electronic keyboard 100 of the third embodiment of the present invention, a determination is made as to whether pressed keys constitute a dissonance, and, when the pressed keys constitute a dissonance, the special sound producing processing different from the normal sound producing processing is performed. Accordingly, a child can enjoy playing the electronic keyboard 100 of the embodiment without feeling bored.

When a sound of a correct chord is produced in the special sound producing processing, an effect of making the user aware of random pressing of keys is lowered. However, sounds which are correct to a certain degree are produced irrespective of how the keyboard is played. Accordingly, an advantage of making a child familiar with a music instrument and music can be expected.

The configuration may also be such that a retrieval processing for retrieving pattern data including a largest number of a plurality of pitch information (note number) corresponding to a plurality of operation elements operated by a performer from a memory is executed, and a sound is emitted from a speaker based on a plurality of pitch information shown by the pattern data retrieved by the retrieval processing.

In this manner, it is possible to expect an advantage of increased possibility that a chord intended by a performer is output.

The configuration may also be such that retrieval processing for retrieving pattern data that includes a root at pitch information of any of a plurality of pitch information corresponding to a plurality of operation elements operated by a performer from a memory is executed. When a plurality of pattern data including first pattern data and second pattern data are retrieved by the retrieval processing, a sound corresponding to the second pattern data is emitted from the speaker in a set length (for example, several seconds) after at least a sound corresponding to the first pattern data is emitted from the speaker in a set length (for example, several seconds). Further, along with producing of a sound corresponding to pattern data, a plurality of operation elements corresponding to the pattern data may also be lit up.

In this manner, possibility that a performer can remember a chord is increased.

The configuration may also be such that, when first pattern data including a root at pitch information of a lowest sound in a plurality of pitch information corresponding to a plurality of operation elements operated by a performer is stored in a memory, a sound may be emitted from a speaker based on a plurality of pitch information shown by the first pattern data. The configuration may also be such that, when there is no first pattern data, and second pattern data including a root at pitch information of a second lowest sound in a plurality of pitch information corresponding to a plurality of operation elements operated by a performer is stored in a memory, a sound may be emitted from a speaker based on a plurality of pitch information shown by the second pattern data. The configuration may also be such that, when a plurality of pattern data are retrieved, a sound based on one piece of pattern data is emitted from a speaker, or a sound based on each piece of the pattern data is emitted in a set length. As a matter of course, an operation element may also be lit up so that an operation element corresponding to a sound to be produced can be identified.

In this manner, it is possible to expect an advantage of increased possibility that a chord intended by a performer is output.

As described above in detail, according to the embodiment of the present invention, when an infant and a child who have not learned how to play a musical instrument hit the keyboard 101 randomly, a correct sound is produced for a pressed key of a single sound or a plurality of pressed keys that do not constitute a dissonance, or special sound effects and an effect of a light-up key are produced when such keys are not pressed. In this manner, a child becomes familiar with an electronic musical instrument, and a child can also learn how to play a keyboard to produce a correct sound by himself or herself.

Specific embodiments of the present invention were described above, but the present invention is not limited to the above embodiments, and modifications, improvements, and the like within the scope of the aims of the present invention are included in the present invention. It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

The invention claimed is:

1. An electronic musical instrument, comprising:

a plurality of keys that specify different pitches respectively when operated;

a memory that stores pattern data, each pattern data indicating a combination of a plurality of pitches forming a consonance;

a speaker; and a processor that executes processing comprising:

determining processing for determining, in response to an operation of the plurality of keys, whether a combination of the operated keys matches one of the pattern data stored in the memory, first outputting processing for outputting a first sound from the speaker, when the combination of the operated keys matches one of the pattern data, wherein the first sound is generated based on both the pitches specified by the operated keys and sound volume information obtained by the operation, and second outputting processing for outputting a second sound different from the first sound from the speaker, when the combination of the operated keys does not match any of the pattern data, wherein the second sound is generated independently of at least one of the pitches specified by the operated keys and the sound volume information obtained by the operation.

2. The electronic musical instrument according to claim 1, wherein in the second outputting processing, the processor outputs the consonance formed by the pitches indicated by one of the pattern data stored in the memory from the speaker, instead of outputting a dissonance corresponding to the pitches specified by the operated keys.

3. The electronic musical instrument according to claim 1, wherein the processor further executes retrieval processing for retrieving pattern data including a largest number of pitches corresponding to the operated keys from among the pattern data stored in the memory, and, in the second outputting processing outputs a sound from the speaker based on the pitches indicated by the pattern data retrieved in the retrieval processing.

4. The electronic musical instrument according to claim 1, wherein the processor further executes retrieval processing for retrieving pattern data including a root at a pitch of any of the pitches corresponding to the operated keys, and wherein when a plurality of pattern data including first pattern data and second pattern data are retrieved in the retrieval processing, a sound corresponding to the second pattern data is output from the speaker in a set length after at least a sound corresponding to the first pattern data is output from the speaker in a set length.

5. The electronic musical instrument according to claim 1, wherein in the second outputting processing, when there is first pattern data including a root at a pitch of a lowest sound among pitches corresponding to the operated keys, the processor outputs the second sound from the speaker based on the pitches indicated by the first pattern data, and, when there is no first pattern data, and there is second pattern data including a root at a pitch of a second lowest sound among the pitches corresponding to the operated keys, the processor outputs the second sound from the speaker based on the pitches indicated by the second pattern data.

6. The electronic musical instrument according to claim 1, wherein the memory stores a plurality of phrase data, and in the second outputting processing, the processor outputs, from the speaker, the second sound which is based on phrase data among the plurality of phrase data stored in the memory.

7. An electronic musical instrument, comprising:

a plurality of keys that specify different pitches respectively when operated;

a speaker; and a processor that executes processing comprising:

sorting processing for sorting pitches corresponding to operated keys in order from a lowest pitch to a highest pitch or from a highest pitch to a lowest pitch, grouping processing for grouping pitches into a plurality of groups including a group including first pitch and a group including second pitch when a pitch difference between the first pitch and the second pitch, which are adjacent to each other after the sorting performed in the sorting processing, is a major third or larger, first outputting processing for determining that the operated keys are not in a dense state when a pitch difference between any adjacent pitches among pitches included in any of the groups obtained in the grouping processing is not a major second or smaller, and outputting a first sound from the speaker, wherein the first sound is generated based on both the pitches specified by the operated keys and sound volume information obtained by the operation, and second outputting processing for determining that the operated keys are in a dense state when pitch differences between all adjacent pitches included in any of the groups obtained in the grouping processing are a major second or smaller, and outputting a second sound from the speaker, wherein the second sound is generated independently of at least one of the pitches specified by the operated keys and the sound volume information obtained by the operation.

8. The electronic musical instrument according to claim 7, further comprising a memory configured to store a plurality of phrase data, wherein the processor outputs a voice based on a piece of phrase data among the plurality of phrase data stored in the memory from the speaker, in the second outputting processing.

9. The electronic musical instrument according to claim 7, further comprising a memory configured to store a display pattern, wherein when the pitch differences between all adjacent pitches included in any of the groups obtained in the grouping processing are a major second or smaller, the processor determines that the operated keys are in the dense state, executes the second outputting processing, and also executes displaying processing for performing display in accordance with the display pattern stored in the memory.

10. The electronic musical instrument according to claim 9, wherein the display pattern is a light emission pattern for lighting up an operation element, and the displaying processing lights up the keys in accordance with the light emission pattern.

11. A method executed by a computer of an electronic musical instrument that includes a plurality of keys that specify different pitches respectively when operated, a memory that stores pattern data, each pattern data indicating a combination of a plurality of pitches forming a consonance, and a speaker, the method comprising:

determining, in response to an operation of the plurality of keys, whether a combination of the operated keys matches any of the pattern data stored in the memory, outputting a first sound from the speaker, when the combination of the operated keys matches one of the pattern data, wherein the first sound is generated based on both the pitches specified by the operated keys and sound volume information obtained by the operation, and outputting a second sound different from the first sound from the speaker, when the combination of the operated keys does not match any of the pattern data, wherein the second sound is generated independently of at least one of the pitches specified by the operated keys and the sound volume information obtained by the operation.

12. A method executed by a computer of an electronic musical instrument that includes a plurality of keys that specify different pitches respectively when operated, and a speaker, the method comprising:

sorting pitches corresponding to operated keys in order from a lowest pitch to a highest pitch or from a highest pitch to a lowest pitch, grouping pitches into a plurality of groups including a group including first pitch and a group including second pitch when a pitch difference between the first pitch and the second pitch, which are adjacent to each other after the sorting of, is a major third or larger, determining that the operated keys are not in a dense state when a pitch difference between any adjacent pitches among pitches included in any of the groups obtained in the grouping is not a major second or smaller, and outputting a first sound from the speaker, wherein the first sound is generated based on both the pitches specified by the operated keys and sound volume information obtained by the operation, and determining that the operated keys are in a dense state when pitch differences between all adjacent pitches included in any of the groups obtained in the grouping processing are a major second or smaller, and outputting a second sound from the speaker, wherein the second sound is generated independently of at least one of the pitches specified by the operated keys and the sound volume information obtained by the operation.

* * * * *